US006145903A

United States Patent [19]

Stinis

[11] Patent Number: 6,145,903

[45] Date of Patent: Nov. 14, 2000

[54] HOISTING FRAME AND METHOD FOR HOISTING CONTAINERS

[75] Inventor: Cornelis Stinis, Krimpen Aan de Lek, Netherlands

[73] Assignee: Stinis Beheer B.V., Krimpen Aan De Lek, Netherlands

[21] Appl. No.: 09/171,723

[22] PCT Filed: Apr. 25, 1997

[86] PCT No.: PCT/NL97/00221

§ 371 Date: Mar. 18, 1999

§ 102(e) Date: Mar. 18, 1999

[87] PCT Pub. No.: WO97/39973

PCT Pub. Date: Oct. 30, 1997

[30] Foreign Application Priority Data

Apr. 25, 1996 [NL] Netherlands ..... 1002941

[51] Int. Cl.[7] ..... B66C 1/10

[52] U.S. Cl. ..... 294/81.21; 294/81.1

[58] Field of Search ..... 294/68.3, 65, 81.1, 294/81.2, 81.21, 81.3, 81.4, 81.5, 81.51, 81.53, 81.6, 81.61, 87.1; 414/460, 461, 607, 608

[56] References Cited

U.S. PATENT DOCUMENTS

| | | | |
|---|---|---|---|
| 3,558,176 | 1/1971 | Fathauer et al. | 294/81.21 |
| 3,671,069 | 6/1972 | Martin et al. | 297/81.1 |
| 3,709,543 | 1/1973 | Tax et al. | 294/81.2 |
| 5,280,980 | 1/1994 | Coatta | 294/81.1 |

FOREIGN PATENT DOCUMENTS

| | | | |
|---|---|---|---|
| 55874 | 7/1982 | European Pat. Off. | 294/81.1 |
| 1951531 | 5/1971 | Germany | 294/81.2 |
| 2538746 | 3/1977 | Germany | 294/81.53 |
| 2815186 | 2/1979 | Germany | 294/81.21 |
| 1379969 | 1/1975 | United Kingdom | 294/81.21 |

*Primary Examiner*—Johnny D. Cherry

*Attorney, Agent, or Firm*—Webb Ziesenheim Logsdon Orkin & Hanson, P.C.

[57] ABSTRACT

The invention relates to a hoisting frame, specifically for hoisting containers, including a longitudinally adjustable beam having a plurality of outer pickup elements arranged at ends of the beam and inner pickup elements arranged near a center of the beam. The inner pickup elements are connected to the beam and moveable in longitudinal direction. The inner pickup elements are moveable along the beam in pairs and are arranged in pairs on a saddle placed transversely on the beam and slideable therealong. The invention also relates to a method for transporting containers by use of such a hoisting frame. The method steps include picking up at least two adjacent containers at a first location, lifting the containers and moving them through the air to a second location, and lowering the containers at the second location. Additionally, at least one of the containers is moved in a longitudinal direction relative to the hoisting frame between lifting and lowering thereof. The hoisting frame of the invention allows containers stacked with various spacings to be transported in double-acting operation.

10 Claims, 2 Drawing Sheets

HOISTING FRAME AND METHOD FOR HOISTING CONTAINERS

BACKGROUND OF THE INVENTION

1. Field of the Invention

The present invention relates to a hoisting frame, specifically for hoisting containers, that includes a longitudinally adjustable beam having a plurality of outer pickup elements arranged at its ends and inner pickup elements arranged near its center.

2. Description of the Prior Art

Such a hoisting frame is generally known, and may be used for hoisting two containers placed with their end faces adjacent one another. A problem which occurs here is that the positioning of the two containers adjacent one another is not always constant, and that therefore the spacing of the containers often varies. Thus in practice it is often not possible to pick up two containers at the same time with a single hoisting frame, so that it is then necessary to shorten the hoisting frame again for subsequently picking up the containers individually. This of course leads to a serious loss of time.

This problem occurs especially when transferring containers between shore and ship. Onshore containers will usually be stacked with a virtually constant spacing of no more than approximately 80 millimeters, whereas the stacking of containers on a ship depends on the specific structure of the ship, and will therefore vary from ship to ship. This is due to the requirement that the containers on a ship should be well stowed. This has for its result that during loading or unloading a container ship, it is often impossible to handle two containers at the same time, so that such loading or unloading takes a relatively much long time.

The invention therefore aims to provide a hoisting frame with which the above-mentioned drawbacks are obviated.

SUMMARY OF THE INVENTION

According to the invention, this is accomplished in that at least the inner pickup elements are connected to the beam moveable in longitudinal direction. In this way the hoisting frame may be easily adapted to variations in spacing between containers onshore and onboard a ship.

Since a container must normally be picked up by two inner and two outer pickup elements, the inner pickup elements are preferably moveable along the beam in pairs. A structurally simple and robust embodiment of the hoisting frame is obtained when the inner pickup elements are each arranged in pairs on a saddle placed transversely on the beam and slideable therealong.

Although in principle the containers may form a shape and force defining connection between the inner and outer pickup elements, advantageously the outer pickup elements are connectable to the corresponding inner pickup elements and concurrently moveable therewith. In this way the container is not additionally stressed during movement of the pickup elements. Preferably the beam comprises a central part and at least two arms carrying the outer pickup elements and being moveable in longitudinal direction relative to the central part, each saddle being arranged to be releasably fixed to a corresponding arm. Thus a simple mechanical coupling is formed between the inner and outer pickup elements.

Preferably the hoisting frame comprises controllable means for moving each arm and the saddle connected thereto relative to the central part. These moving means might be formed by means for adjusting the length of the beam for use with one or two containers which are already present in the hoisting frame, but they preferably comprise at least one hydraulic cylinder arranged between the central beam part and the saddle.

The invention also relates to a method for transporting containers using the hoisting frame described above. The known manner of transporting containers comprises picking up at least two adjacent containers at a first location, lifting the containers and moving them through the air to a second location, and lowering the containers at the second location, and is characterized according to the present invention, in that at least one of the containers is moved in longitudinal direction relative to the hoisting frame between lifting and lowering thereof. Preferably the spacing of the containers is changed between lifting and lowering thereof. In this way containers which are stacked with a certain spacing at a first location, for instance onshore, may easily be picked up and transported to a second location, for instance onboard a ship, where they may be stacked with a different spacing. It is thus possible to pick up and transport containers which should be stacked with different spacings at different locations at least two at a time, whereby the transport capacity is greatly increased.

Advantageously the movement of the containers is asymmetrical relative to a center point of the hoisting frame. In this way an eccentric loading of the hoisting frame and therefore of the crane carrying the hoisting frame, for instance in case one of the two containers is fully loaded and the other one is totally empty, may be prevented. Thus no special requirements are necessary for cranes with which containers may be handled two at a time.

The invention is now illustrated by way of an example, with reference being made to the drawing,

DETAILED DESCRIPTION OF THE PREFERRED EMBODIMENT

Figure 1:
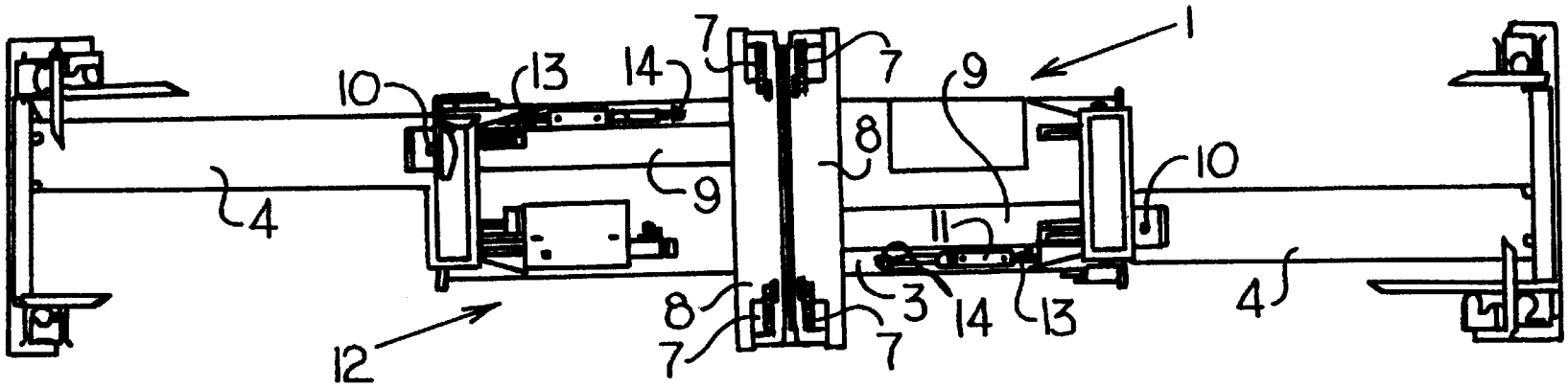
FIG. 1 is a top view of a hoisting frame according to the invention in its initial position for picking up two containers arranged at the nominal spacing.
Figure 2:
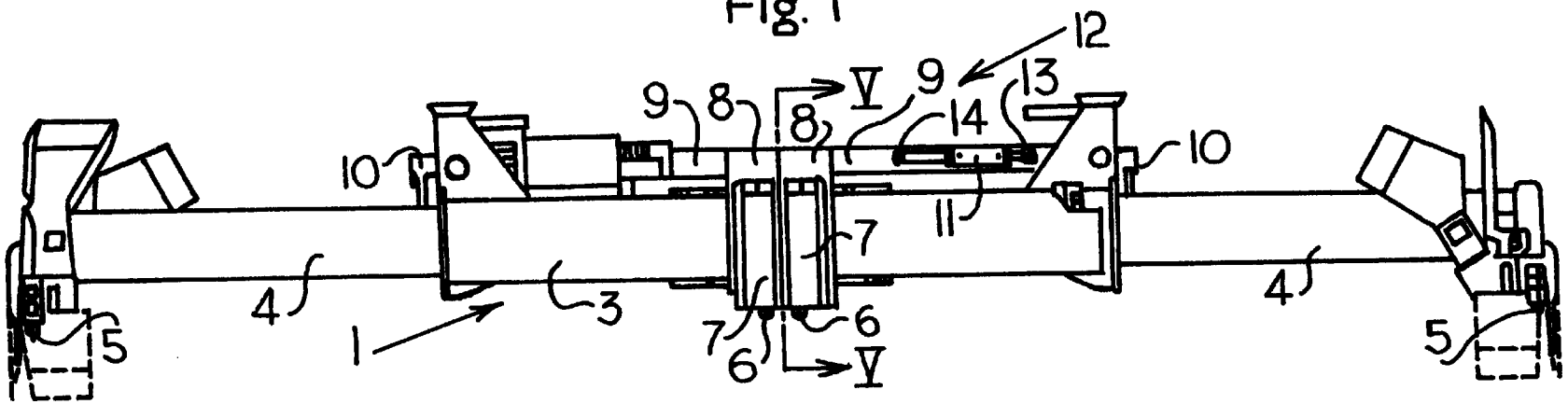
FIG. 2 is a side view of the hoisting frame of FIG. 1.
Figure 6:
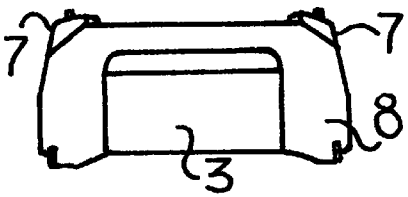
FIG. 6 is a view corresponding to FIG. 5 of the hoisting frame in its position of rest, in which the pickup elements are retracted.
Figure 5:
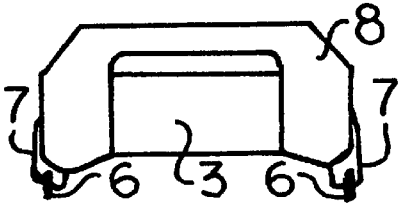
FIG. 5 is a cross sectional view of the hoisting frame taken along the line V—V in FIG. 2.
Figure 3:
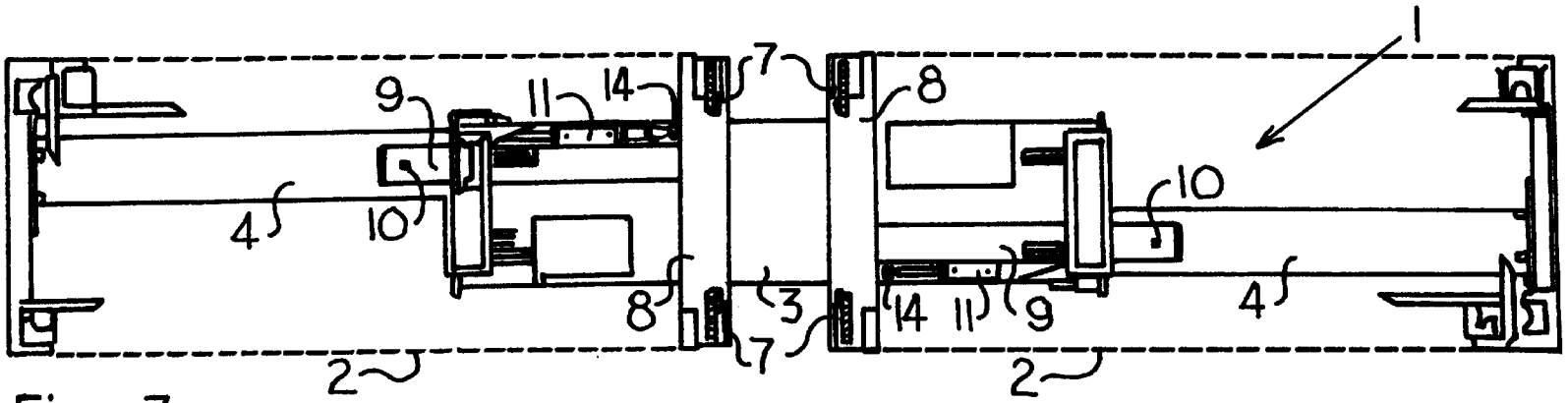
FIG. 3 is a top view of the hoisting frame of FIGS. 1 and 2 in an extended state for picking up containers of which the spacing deviates from the nominal value.
Figure 4:
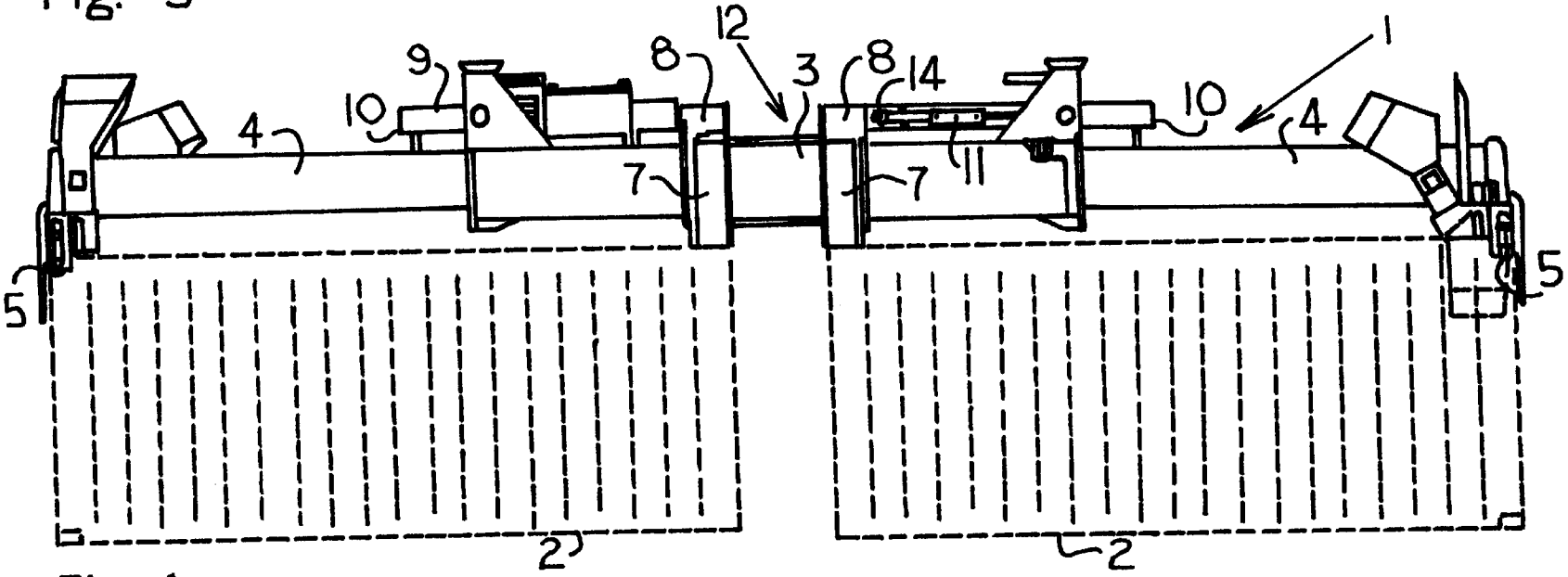
FIG. 4 is a side view of the hoisting frame in the position as illustrated in FIG. 3.

Referring to the drawings, a hoisting frame 1, a so-called "twinlift" adapted for handling various sizes of containers 2 is shown. Thus the hoisting frame 1 may handle containers having length-wise dimensions of 20, 30, 35, 40, 45, 48 and 53 feet during single-acting operation, while two 20 feet containers may be handled at the same time in double-acting or "twinlift" operation. For handling the various sizes of containers the hoisting frame 1 is adjustable in longitudinal direction, and is formed by a central beam part 3 and two arms 4 slideably arranged in the central part 3. At the ends of the arms 4 outer pickup elements 5, so-called "twistlocks" are arranged. Furthermore inner pickup elements 6 are arranged on the central part 3 of the beam, also in the shape of so-called "twistlocks". The inner pickup elements 6 are retractable, since they are only needed during "twinlift" operations. To this end the pickup elements 6 are arranged in cradles 7 that are slideably arranged on the central part 3 of the hoisting frame 1.

In order to be able to pick up pairs of containers 2 placed with various spacing during "twinlift" operations of the hoisting frame 1, the inner pickup elements 6 are arranged in pairs on a saddle 8 placed transversely over the central beam part 3 and slideable therealong. Each saddle 8 may for instance be slideable over a length of 725 millimeters, so that spacings up to 1.45 meter may be bridged. Each saddle 8 further comprises an outrigger 9 through which it may be releasably fixed to the corresponding sliding arm 4. To this end the outrigger 9 in the illustrated example is provided with a locking pin 10 which engages the arm 4. In this manner the nominal distance of 20 feet between the outer pickup elements 5 and the inner pickup elements 6 is fixed. Other ways of locking, for instance by means of a hydraulic lock are of course conceivable. It is even envisaged that locking the saddle 8 and the arm 4 relative to one another may be dispensed with, since the container 2 suspended therefrom forms a force and shape defining connection between these two parts.

When the saddle 8 is thus fixed to the arm 4, the assembly of arm and saddle may be moved in longitudinal direction of the hoisting frame 1. This could be performed by means of the drive for telescopically extending or retracting the arms 4, but preferably a separate double acting drive cylinder 11 is used, having one end 13 fixed to the outrigger 9 and its other end 14 to the central beam part 3.

In this way two 20 feet containers 2 may be handled in each position of the arms 4, with the position of the arms 4 being adapted to the mutual position of the containers to be picked up. Movement of the arms 4 is possible both in unloaded and loaded condition, even when the containers 2 carried by the hoisting frame 1 are themselves loaded. By using cylinders 11 for the movement, this may furthermore be performed steplessly. Each cylinder 11 also acts as safeguard against unintentional movement of the arm 4, for instance when this is unexpectedly subject to a horizontal force due to a collision or the like. The containers 2 are thus prevented from breaking loose from the hoisting frame 1.

The movement of the inner and outer pickup elements 5, 6 by moving the arms 4 and the saddles 8 may take place synchronously on both sides of the hoisting frame 1, for instance as a result of a mechanical, hydraulic or electrical coupling of the driving means, but it is also possible that the pickup elements 5, 6 on one side of the hoisting frame 1 are moved independently of the pickup elements on the other side of the hoisting frame 1. In this way one of the containers 2 might for instance be moved, while the other container remains stationary. This leads to the containers 2 being asymmetrically suspended from the hoisting frame 1. It is even possible to move both containers 2 in the same direction, whether or not they are coupled to each other. In this way a strongly eccentric loading of the hoisting frame 1, for instance when one of the containers is completely loaded and the other container is totally empty, may be prevented. This is important since a strongly eccentric loading of the hoisting frame leads to a corresponding eccentric loading of a crane carrying the hoisting frame, which for instance in case of a riding crane might result in a number of its wheels being lifted from the ground, and in the most extreme case might lead to toppling of the crane. Due to the possibility of moving the containers relative to the hoisting frame, in principle any crane may be used for similtaneously handling two containers.

Instead of the movement of the pickup elements by means of hydraulic cylinders, belt drives and other drive mechanisms and controlled by electronic control systems as described above, it is of course also conceivable to perform this movement by hand. This may be useful when only sporadically will a container have to be moved in longitudinal direction of the hoisting frame, in which case the additional investment for the controllable moving means will probably not be justified.

For controlling the movements of the various parts of the hoisting frame, standard control lines present between a crane and a hoisting frame are advantageously used. In any case there are lines for telescopically lengthening or shortening the hoisting frame, since each hoisting frame offers this possibility, whereas for a conventional double acting hoisting frame there will further be control lines for retracting and extending the pickup elements. By appropriately connecting the control of the additional mechanisms for longitudinally moving and/or locking the pickup elements with those of the moving mechanisms present on a conventional hoisting frame, the standard control lines may suffice, whereby the hoisting frame according to the invention may easily be exchanged for conventional hoisting frames.

Since the arms 4 will generally be driven simultaneously by means of for instance a belt drive, two indicators for each cylinder 11 are sufficient for automatically determining six fixed positions, including the fully extended final position. Furthermore each desired position may be determined by means of encoders. It is further possible to switch from single acting to "twinlift" operation through a single remote switch, for instance from the cabin of the crane, and to change the programmed dimensions in the direction of width.

In this way the hoisting frame according to the invention allows the spacing of two containers that are to be picked up or one already picked up thereby to be steplessly adjusted. For controlling this the wiring already present on such a hoisting frame may be used. Furthermore, the nominal distance of the "twistlocks" is always maintained in such hoisting frame, while the picked up containers remain fully locked in each position of the frame.

What is claimed is:

1. A hoisting frame for hoisting containers, comprising a longitudinally adjustable beam having a plurality of outer pickup elements arranged at ends of the beam and a plurality of inner pickup elements arranged near a center of the beam, the inner pickup elements connected to the beam and moveable in a longitudinal direction along the beam, and a controllable means for moving the inner pickup elements.

2. The hoisting frame according to claim 1, wherein the inner pickup elements are moveable along the beam in pairs.

3. The hoisting frame according to claim 2, wherein the inner pickup elements are arranged in pairs on at least one saddle placed transversely on the beam and slideable therealong.

4. The hoisting frame according to claim 3, wherein the beam includes a central part and at least two arms carrying the outer pickup elements, the at least two arms moveable in a longitudinal direction relative to the central part, and wherein each of the saddles is releasably fixed to one of the arms.

5. The hoisting frame according to claim 4, wherein the controllable means moves each arm and the saddle connected thereto relative to the central part.

6. The hoisting frame according to claim 5, wherein the controllable means include at least one hydraulic cylinder arranged between the central beam part and each of the saddles.

7. The hoisting frame according to claim 3, wherein the beam is configured such that the outer pickup elements and the inner pickup elements can be moved together.

8. The hoisting frame according to claim 3, wherein the beam includes a central part and at least two arms carrying the outer pickup elements, the at least two arms moveable in a longitudinal direction relative to the central part, and wherein each of the saddles is releasably fixed to one of the arms.

9. The hoisting frame according to claim 2, wherein the beam is configured such that the outer pickup elements and the inner pickup elements can be moved together.

10. The hoisting frame according to claim 1, wherein the beam is configured such that the outer pickup elements and the inner pickup elements can be moved together.

* * * * *

UNITED STATES PATENT AND TRADEMARK OFFICE

CERTIFICATE OF CORRECTION

PATENT NO : 6,145,903
DATED : November 14, 2000
INVENTOR(S) : Cornelis Stinis

It is certified that error appears in the above-identified patent and that said Letters Patent is hereby corrected as shown below:

Column 1 Line 34, after "relatively" delete "much".

Column 2 Line 34 "drawing," should read --drawings.--.

Column 2 Line 36 "DRAWING" should read --DRAWINGS--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*